US010077494B2

(12) United States Patent
Lin et al.

(10) Patent No.: US 10,077,494 B2
(45) Date of Patent: Sep. 18, 2018

(54) PROCESS FOR FORMING DIFFUSION COATING ON SUBSTRATE

(71) Applicant: GENERAL ELECTRIC COMPANY, Schenectady, NY (US)

(72) Inventors: Dechao Lin, Greer, SC (US); David Vincent Bucci, Simpsonville, SC (US); Shan Liu, Central, SC (US); Jon Schaeffer, Simpsonville, SC (US); John Adams, Simpsonville, SC (US); Ron Hendrix, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 15/264,313

(22) Filed: Sep. 13, 2016

(65) Prior Publication Data

US 2018/0073123 A1 Mar. 15, 2018

(51) Int. Cl.

| | |
|---|---|
| ***C23C 10/18*** | (2006.01) |
| ***F01D 5/28*** | (2006.01) |
| ***F01D 9/04*** | (2006.01) |
| ***C23C 30/00*** | (2006.01) |
| ***C23C 28/00*** | (2006.01) |
| ***C23C 10/02*** | (2006.01) |
| ***C23C 10/60*** | (2006.01) |
| ***F01D 11/08*** | (2006.01) |
| ***F01D 25/00*** | (2006.01) |

(52) U.S. Cl.

CPC ..... *C23C 10/18* (2013.01); *C23C 10/02* (2013.01); *C23C 10/60* (2013.01); *C23C 28/321* (2013.01); *C23C 30/00* (2013.01); *F01D 5/288* (2013.01); *F01D 9/041* (2013.01); *F01D 11/08* (2013.01); *F01D 25/005* (2013.01); *F05D 2220/32* (2013.01); *F05D 2230/90* (2013.01); *F05D 2300/611* (2013.01)

(58) Field of Classification Search

CPC ..... C23C 10/02; C23C 10/18; C23C 10/60; C23C 28/321; C23C 30/00; F01D 5/288; F01D 9/041

See application file for complete search history.

(56) References Cited

U.S. PATENT DOCUMENTS

| | | | | |
|---|---|---|---|---|
| 2,685,543 | A | 8/1954 | Sindeband | |
| 3,741,791 | A | 6/1973 | Maxwell et al. | |
| 3,867,266 | A | 2/1975 | Miyata et al. | |
| 3,903,338 | A | 9/1975 | Cook et al. | |
| RE29,212 | E | 5/1977 | Baldi et al. | |
| 4,617,202 | A * | 10/1986 | Baldi | B05B 7/226 427/253 |
| 5,217,757 | A | 6/1993 | Milaniak et al. | |
| 5,366,765 | A | 11/1994 | Milaniak et al. | |
| 6,022,632 | A | 2/2000 | Olson et al. | |
| 6,110,262 | A | 8/2000 | Kircher et al. | |
| 6,296,705 | B1 | 10/2001 | Ireland et al. | |
| 6,395,406 | B1 * | 5/2002 | Sangeeta | B22F 1/0003 148/527 |
| 6,444,054 | B1 | 9/2002 | Kircher et al. | |
| 6,706,325 | B2 | 3/2004 | Spitsberg et al. | |
| 6,730,179 | B2 | 5/2004 | Kircher | |
| 7,150,926 | B2 | 12/2006 | Strangman | |
| 7,597,966 | B2 | 10/2009 | Spitsberg et al. | |
| 8,124,426 | B2 | 2/2012 | Gaidis | |
| 8,262,812 | B2 | 9/2012 | Helmick et al. | |
| 8,596,985 | B2 | 12/2013 | Walker et al. | |
| 8,741,381 | B2 | 6/2014 | Zhang et al. | |
| 8,916,005 | B2 | 12/2014 | Cavanaugh et al. | |
| 8,973,808 | B2 | 3/2015 | Lin et al. | |
| 2004/0115355 | A1 | 6/2004 | Bauer et al. | |
| 2005/0014010 | A1 | 1/2005 | Dumm et al. | |
| 2005/0031877 | A1 | 2/2005 | Gigliotti, Jr. et al. | |
| 2006/0141283 | A1 | 6/2006 | Madhava | |
| 2007/0009660 | A1 | 1/2007 | Sasaki et al. | |
| 2009/0126833 | A1 * | 5/2009 | Cavanaugh | C23C 10/20 148/248 |
| 2009/0169750 | A1 * | 7/2009 | Wilkins | C23C 10/02 427/287 |
| 2010/0151125 | A1 | 6/2010 | Kool et al. | |

(Continued)

FOREIGN PATENT DOCUMENTS

| | | | | |
|---|---|---|---|---|
| GB | 2401117 A | * 11/2004 | | C23C 10/04 |
| JP | 5696067 A | 8/1981 | | |

(Continued)

OTHER PUBLICATIONS

Harada and Negoro. Inner Diffusion Behavior of Chromium Diffusion Coating Layer Studies on Chromium Diffusion Coating of Nickel Superalloys (1973)(Part 7). (Year: 1973).*

(Continued)

*Primary Examiner* — Dah-Wei D. Yuan

*Assistant Examiner* — Jose Hernandez-Diaz

(74) *Attorney, Agent, or Firm* — McNees Wallace & Nurick LLC

(57) ABSTRACT

A process for forming a diffusion coating on a substrate is disclosed, including preparing a slurry including a donor metal powder, an activator powder, and a binder, and applying the slurry to the substrate. The slurry is dried on the substrate, forming a slurry layer on the substrate. A covering composition is applied over the slurry layer, and the covering composition is dried, forming at least one covering layer enclosing the slurry layer against the substrate. The slurry layer and the at least one covering layer are heated to form the diffusion coating on the substrate, the diffusion coating including an additive layer and an interdiffusion zone disposed between the substrate and the additive layer.

20 Claims, 2 Drawing Sheets

(56) References Cited

U.S. PATENT DOCUMENTS

| | | | | |
|---|---|---|---|---|
| 2011/0058591 | A1 | 3/2011 | Lim et al. | |
| 2011/0058952 | A1 | 3/2011 | Pillhoefer et al. | |
| 2012/0060721 | A1 | 3/2012 | Kool et al. | |
| 2012/0094021 | A1* | 4/2012 | MacGregor | C23C 10/18 427/230 |
| 2012/0324902 | A1 | 12/2012 | Pope et al. | |
| 2013/0004712 | A1 | 1/2013 | Belov | |
| 2013/0175325 | A1 | 7/2013 | Lin et al. | |
| 2014/0044938 | A1 | 2/2014 | Pillhoefer et al. | |
| 2014/0044986 | A1 | 2/2014 | Pillhoefer et al. | |
| 2015/0144496 | A1* | 5/2015 | Morris | F01D 5/186 205/261 |
| 2015/0197841 | A1* | 7/2015 | Tang | C23C 10/20 427/252 |
| 2016/0010472 | A1* | 1/2016 | Murphy | C23C 10/02 416/241 R |
| 2016/0230284 | A1* | 8/2016 | McDermott | C23C 10/20 |

FOREIGN PATENT DOCUMENTS

| | | | |
|---|---|---|---|
| JP | 63190158 | A | 8/1988 |
| JP | 2003183809 | A | 7/2003 |
| JP | 2006199988 | A | 8/2006 |

OTHER PUBLICATIONS

Huiliang et al. A Novel Duplex Low-temperature Chromizing Process at 500° C. Journal of Material Science Technology vol. 23 No. 6 (2007) (Year: 2007).*

G.W. Goward; "Progress in coatings for gas turbine airfoils," Surface and Coatings Technology, Oct. 10, 1998, vols. 108-109, pp. 73-79.

Zhu, et al.; "Oxidation of a Novel Chromium Coating with CeO2 Dispersions," Oxidation of Metals, Dec. 2004, vol. 62, Issue 516, pp. 411-426.

Cao, et al.; "A Novel Duplex Low-temperature Chromizing Process at 500 degrees C.," J. Mater Sci. Technol., vol. 23, No. 6, 2007, pp. 823-827.

Cao, et al.; Phase transformations in low-temperature chromized 0.45 wt. per cent C plain carbon steel, Surface and Coatings Technology, vol. 201, 2007, pp. 7970-7977.

Sikalidis, ed., Advances in Ceramics—Synthesis and Characterization, Processing and Specific Applications, Chapter 4 by Kimura entitled "Molten Salt Synthesis of Ceramic Powders", Aug. 2001, pp. 75-100.

Leferink, et al.; "Chromium Diffusion Coatings on Low-Alloyed Steels for Corrosion Protection Under Sulphidizing Conditions," VGB Kraftwerkstechnik, vol. 73, No. 3, 1993, pp. 1-14.

Kool, et al.; "Chromide Coatings, Articles Coated with Chromide Coatings, and Processes for Forming Chromide Coatings," filed Dec. 30, 2014 as U.S. Appl. No. 14/585,890 (not yet published).

APV Engineered Coatings, Safety Data Sheet for S-0099-01, date prepared Sep. 17, 2015, pp. 1-8, Akron.

Wang, et al.; "Diffusion Coatings for Metal-Based Substrate and Methods of Preparation Thereof", filed Jun. 24, 2015 as U.S. Appl. No. 14/749,096 (not yet published).

Zhang, et al.; "Coating Process for Applying a Bifurcated Coating", filed Jun. 22, 2016 as U.S. Appl. No. 15/189,854 (not yet published).

Extended European Search Report and Opinion issued in connection with corresponding EP Application No. 17189764.8 dated Nov. 7, 2017.

* cited by examiner

PROCESS FOR FORMING DIFFUSION COATING ON SUBSTRATE

FIELD OF THE INVENTION

The present invention is directed to a process for forming a diffusion coating on a substrate. More particularly, the present invention is directed to a process for forming a diffusion coating on a substrate utilizing a covering composition to enclose a slurry against the substrate during formation of the diffusion coating.

BACKGROUND OF THE INVENTION

Gas turbines include components, such as buckets (blades), nozzles (vanes), combustors, shrouds, and other hot gas path components which are coated to protect the components from the extreme temperatures, chemical environments and physical conditions found within the gas turbines. Certain coating systems, such as diffusion coatings, may be formed by applying a layer of coating precursor material to the area of a substrate to be coated, and subjecting the coating precursor material and the substrate to conditions suitable for forming the coating system.

The formation of coating systems may be incomplete or inefficient, however, due the interaction of the coating precursor material with the external environment in addition or in lieu of the interaction of the coating precursor material with the desired substrate. In one example, formation of a diffusion coating may be inhibited or incomplete due to the release of coating-forming gas or vapor from the coating precursor material to the exterior environment without the gas or vapor contacting the substrate surface to be coated. Further, such incomplete or inhibited coating may be exacerbated when the surface to be coated includes narrow channels, cracks in the substrate surface, or other reduced-access areas.

BRIEF DESCRIPTION OF THE INVENTION

In an exemplary embodiment, a process for forming a diffusion coating on a substrate includes preparing a slurry including a donor metal powder, an activator powder, and a binder, and applying the slurry to the substrate. The slurry is dried on the substrate, forming a slurry layer on the substrate. A covering composition is applied over the slurry layer, and the covering composition is dried, forming at least one covering layer enclosing the slurry layer against the substrate. The slurry layer and the at least one covering layer are heated to form the diffusion coating on the substrate, the diffusion coating including an additive layer and an interdiffusion zone disposed between the substrate and the additive layer.

Other features and advantages of the present invention will be apparent from the following more detailed description of the preferred embodiment, taken in conjunction with the accompanying drawings, which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Provided are processes for forming diffusion coatings on substrates. Embodiments of the present disclosure, in comparison to processes not utilizing one or more features disclosed herein, decrease costs, increase process efficiency, increase operating lifetime, increase coating uniformity, increase crack coating penetration, add diffusion coating around cracks to prevent crack propagation, ensure a uniform coating, or a combination thereof.

Figure 1:
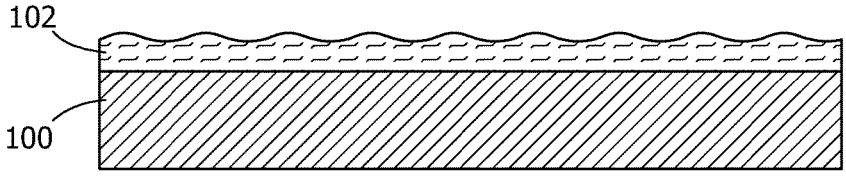
FIG. 1 is a sectioned view of a substrate with a slurry applied thereto, according to an embodiment of the present disclosure.
Figure 2:
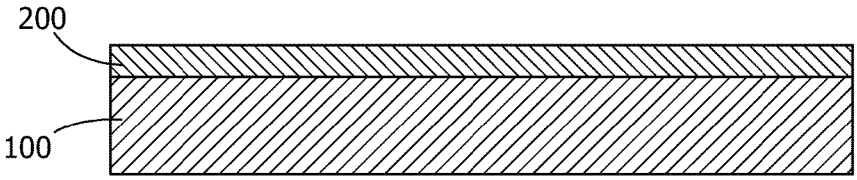
FIG. 2 is a sectioned view of the substrate of FIG. 1 after the slurry has been dried to a slurry layer, according to an embodiment of the present disclosure.
Figure 3:
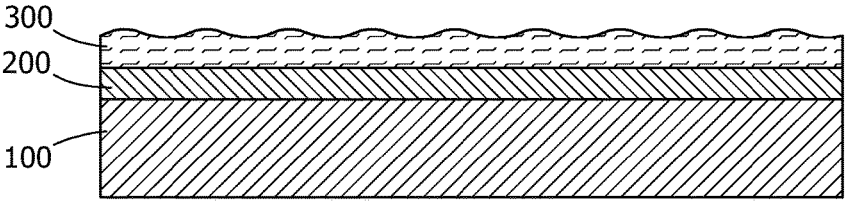
FIG. 3 is a sectioned view of the substrate of FIG. 2 with a covering composition applied over the slurry layer, according to an embodiment of the present disclosure.
Figure 4:
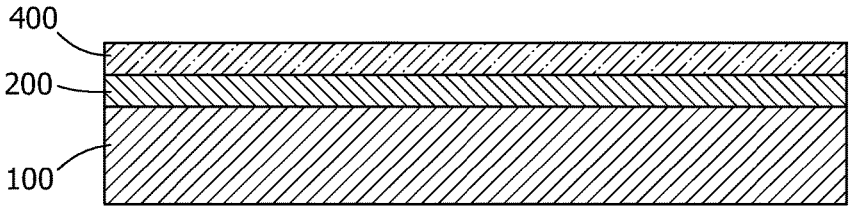
FIG. 4 is a sectioned view of the substrate of FIG. 3 after the covering composition has been dried to at least one covering layer, according to an embodiment of the present disclosure.
Figure 5:
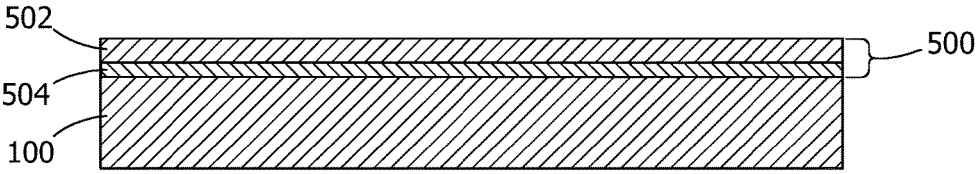
FIG. 5 is a sectioned view of the substrate of FIG. 4 after formation of a diffusion coating on the substrate, according to an embodiment of the present disclosure.

Referring to FIGS. 1-5, in one embodiment, a process for forming a diffusion coating 500 on a substrate 100 is disclosed. The diffusion coating 500 may be any suitable diffusion coating, including, but not limited to, an aluminide diffusion coating, a chromide diffusion coating, or a combination thereof. Referring to FIG. 1, the process includes preparing a slurry 102 including a donor metal powder, an activator powder, and a binder. The slurry 102 is applied to the substrate 100. Referring to FIG. 2, the slurry 102 is dried on the substrate 100, forming a slurry layer 200 on the substrate 100. Referring to FIG. 3, a covering composition 300 is applied over the slurry layer 200. Referring to FIG. 4, the covering composition 300 is dried, forming at least one covering layer 400 enclosing the slurry layer 200 against the substrate 100. Referring to FIG. 5, the slurry layer 200 and the at least one covering layer 400 are heated to form the diffusion coating 500 on the substrate 100, the diffusion coating including an additive layer 502 and an interdiffusion zone 504 disposed between the substrate 100 and the additive layer 502. The at least one covering layer 400 may be removed following the heating of the slurry layer 200 and the at least one covering layer 400. Any portion of the slurry layer 200 remaining following the heating of the slurry layer 200 and the at least one covering layer 400 may also be removed. The heating of the slurry layer 200 and the at least one covering layer 400 may transform the at least one covering layer 400 to residues, in which case the removal of the at least one covering layer 400 may include removal of the residues of the at least one covering layer 400. Applying the covering composition 300 and drying the covering composition 300 to form at least one covering layer 400 may be repeated to form a plurality of covering layers 400 including any suitable number of covering layers 400.

In one embodiment, the at least one covering layer 400 partially covers the slurry layer 200. In another embodiment, the at least one covering layer 400 fully covers the slurry layer 200. In yet another embodiment, the at least one covering layer 400 and the substrate 100 enclose the slurry layer 200. In a further embodiment, the at least one covering layer 400 and the substrate 100 hermetically enclose the slurry layer 200.

Applying the at least one covering layer 400 over the slurry layer 200 may increase the uniformity of the diffusion coating 500 relative to a comparable process lacking the at least one covering layer 400. In one embodiment, the diffusion coating 500 has heightened uniformity. As used herein, "heightened uniformity" indicates that the diffusion coating 500 covers the substrate 100 without break throughout the area which was covered by the at least one covering layer 400, and the thickness of the diffusion coating 500 (including both the additive layer 502 and the interdiffusion zone 504) does not vary across the diffusion coating 500 by more than about 50% of the greatest thickness of the diffusion coating 500. In another embodiment, the diffusion coating 500 is substantially uniform. As used herein, "substantially uniform" indicates that the diffusion coating 500 covers the substrate 100 without break throughout the area which was covered by the at least one covering layer 400, and the thickness of the diffusion coating 500 (including both the additive layer 502 and the interdiffusion zone 504) does not vary across the diffusion coating 500 by more than about 25% of the greatest thickness of the diffusion coating 500. In yet another embodiment, the diffusion coating 500 is essentially uniform. As used herein, "essentially uniform" indicates that the diffusion coating 500 covers the substrate 100 without break throughout the area which was covered by the at least one covering layer 400, and the thickness of the diffusion coating 500 (including both the additive layer 502 and the interdiffusion zone 504) does not vary across the diffusion coating 500 by more than about 10% of the greatest thickness of the diffusion coating 500. In another embodiment, the diffusion coating 500 is uniform. As used herein, "uniform" indicates that the diffusion coating 500 covers the substrate 100 without break throughout the area which was covered by the at least one covering layer 400, and the thickness of the diffusion coating 500 (including both the additive layer 502 and the interdiffusion zone 504) does not vary across the diffusion coating 500 by more than about 5% of the greatest thickness of the diffusion coating 500.

The covering composition 300 may include any suitable additives, including, but not limited to, polymer adhesives, ceramic powders, viscosity thinning agents, or a combination thereof. In one embodiment, the covering composition 300 includes at least one polymer adhesive and at least one ceramic powder. Suitable viscosity thinning agents include, but are not limited to, $NH_4Cl$, $NH_4F$, $NH_4Br$, and combinations thereof.

Applying the slurry 102 may include any suitable technique, including, but not limited to, spraying, dipping, painting, brushing, and combinations thereof. Applying the covering composition 300 may include any suitable technique, including, but not limited to spraying, painting, brushing, dipping, and combinations thereof.

The substrate 100 may include any suitable material composition, including, but not limited to, an iron-based superalloy, a nickel-based superalloy, a cobalt-based superalloy, or a combination thereof. The slurry 102 may be applied directly to the substrate 100. In another embodiment, the substrate 100 includes a bond coat. The slurry 102 may be applied directly to the bond coat. The bond coat may be any suitable material, including, but not limited to a MCrAlY, an aluminide diffusion coating, a chromide diffusion coating, or a combination thereof.

In one embodiment, heating the slurry layer 200 and the at least one covering layer 400 to form the diffusion coating 500 includes heating the slurry layer 200 and the at least one covering layer 400 to a temperature within a range of about 550° C. to about 1250° C., alternatively within a range of about 750° C. to about 1200° C., alternatively within a range of about 815° C. to about 1150° C. Heating the slurry layer 200 and the at least one covering layer 400 to form the diffusion coating 500 may include any heating duration, including, but not limited to, a duration of from about 0.5 hours to about 12 hours, alternatively about 2 hours to about 8 hours, alternatively about 4 hours to about 6 hours, alternatively less than about 8 hours, alternatively less than about 6 hours.

Forming the diffusion coating 500 having the additive layer 502 and the interdiffusion zone 504 may include forming the diffusion coating 500 as an additive coating which adds a metal onto the substrate 100, the added metal forming the additive layer 502 as well as interdiffusing with the substrate 100 to form the interdiffusion zone 504 between the substrate 100 and the additive layer 502.

In one embodiment, the process for forming the diffusion coating 500 on the substrate 100 further includes a pre-coating cleaning prior to applying the slurry 102. In another embodiment, the process for forming the diffusion coating 500 includes a post-coating cleaning while removing the at least one covering layer 400 from the diffusion coating 500 or after removing the at least one covering layer 400 from the diffusion coating 500. The post-coating cleaning may include any suitable technique, and may remove the at least one covering layer 400, residues of the at least one covering layer 400 remaining following the heating of the at least one covering layer 400 and the slurry layer 200, the covering composition 300, the slurry layer 200, the slurry 102, impurities, or a combination thereof. The suitable technique for cleaning may include, but is not limited to, ultrasonic cleaning in a solvent bath (e.g., water and a suitable reagent), water flushing, grit blasting, or a combination thereof.

The substrate may be any suitable substrate, including, but not limited to turbine components. Suitable turbine components include, but are not limited to buckets (blades), nozzles (vanes), shrouds, diaphragms, combustors, hot gas path components, or combinations thereof.

In one embodiment, the slurry 102 is an aluminizing slurry, and the donor metal powder includes a metallic aluminum alloy having a melting temperature higher than aluminum (melting point of about 660° C.), the binder includes at least one organic polymer gel, and the diffusion coating 500 formed is an aluminide diffusion coating including an aluminide additive layer as the additive layer 502 and an aluminide interdiffusion zone as the interdiffusion zone 504. The aluminizing slurry may include any suitable composition, including, but not limited to, a composition having, by weight, about 35% to about 65% of the donor metal powder, about 1% to about 50% of the activator powder, and about 25% to about 60% of the binder.

In one embodiment, the donor metal powder of the aluminizing slurry form of the slurry 102 includes metallic aluminum alloyed with chromium, iron, another aluminum alloying agent, or a combination thereof, provided that the alloying agent does not deposit during the diffusion aluminizing process, but instead serves as an inert carrier for the aluminum of the donor material. In a further embodiment, the donor metal powder includes a chromium-aluminum alloy such as, but not limited to, by weight, about 10% to about 60% aluminum, balance chromium and incidental impurities. In another embodiment, the donor metal powder has a particle size of up to 100 mesh (149 μm), alternatively up to −200 mesh (74 μm). Without being bound by theory, it is believed that the donor metal powder being a fine powder reduces the likelihood that the donor metal powder will be lodged or entrapped within the substrate 100.

The activator powder of the aluminizing slurry form of the slurry 102 may include any suitable material, including, but not limited to, ammonium chloride, ammonium fluoride, ammonium bromide, another halide activator or combinations thereof. Suitable materials for the activator powder react with aluminum in the donor metal powder to form a volatile aluminum halide, such as, but not limited to, $AlCl_3$ or $AlF_3$, which reacts at the substrate 100 to deposit aluminum, which diffuses into the substrate 100.

The at least one organic polymer gel of the binder of the aluminizing slurry form of the slurry 102 may include, but is not limited to, a polymeric gel available under the name Vitta Braz-Binder Gel from the Vitta Corporation, and low molecular weight polyols such as polyvinyl alcohol. In one embodiment, the binder further includes a cure catalyst, an accelerant, or both, such as, but not limited to, sodium hypophosphite.

In one embodiment, the aluminizing slurry 102 form of the slurry 102 is free of inert fillers and inorganic binders. The absence of inert fillers and inorganic binders prevents such materials from sintering and becoming entrapped in the substrate 100.

The aluminizing slurry form of the slurry 102 may further include, by weight, about 1% to about 30% ceramic powder, about 1% to about 10% oxide removal agent, or a combination thereof. The ceramic powder may include any suitable material, including, but not limited to, aluminum oxide, chromium oxide, yttrium oxide, zirconium oxide, or a combination thereof. The oxide removal agent may include any suitable material, including, but not limited to, an acid such as acetic acid, hydrochloric acid, acids having acidities between acetic acid and hydrochloric acid, inclusive, or a combination thereof.

In one embodiment, the slurry 102 is a chromizing slurry, and the donor metal powder includes chromium. The chromizing slurry form of the slurry 102 further includes an inorganic salt having a melting point that is less than or equal to about 800° C., and the diffusion coating 500 formed is a chromide diffusion coating including a chromide additive layer as the additive layer 502 and a chromide interdiffusion zone as the interdiffusion zone 504. The chromizing slurry may include any suitable composition, including, but not limited to, a composition having, by weight, about 1% to about 60% of the donor metal powder, about 1% to about 70% of the inorganic salt, about 1% to about 30% of the activator powder, and at least about 1% of the binder.

In one embodiment, the chromizing slurry form of the slurry 102 includes a donor metal powder, an inorganic salt having a melting point that is less than or equal to about 800° C., an activator, and a binder, wherein the donor metal powder includes chromium. The donor metal powder may include chromium in the form for chromium powder, and may further include an aluminum powder. In one embodiment, the chromium powder includes an additive such as aluminum, cobalt, nickel, silicon, or mixtures thereof. The chromizing slurry form of the slurry 102 includes donor metal powder particles having any suitable size, including, but not limited to, particles having a mean diameter of about 1 to about 10 microns (i.e., micrometers (μm)) as measured using a conventional particle size analyzer.

The activator of the chromizing slurry form of the slurry 102 may be any suitable activator, including, but not limited to, ammonium halides, chromium halides, aluminum halides, and mixtures thereof. In one embodiment, the activator is $NH_4Cl$, $NH_4F$, $NH_4Br$, $CrCl_2$, $CrCl_3$, $AlCl_3$, or a combination thereof.

The binder of the chromizing slurry form of the slurry 102 may be any suitable binder which promotes cohesiveness of the chromizing slurry form of the slurry 102 and which decomposes when exposed to a predetermined temperature.

Figure 6:
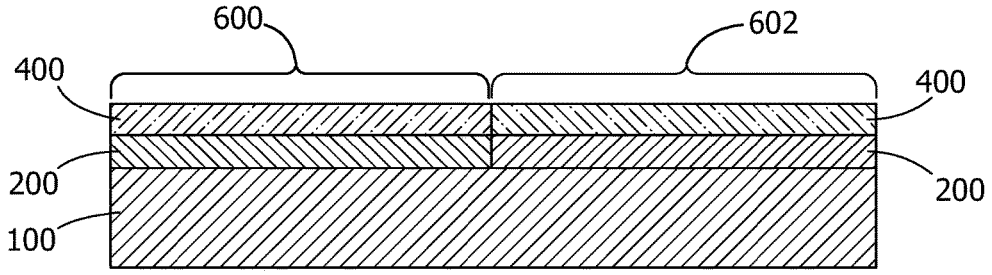
FIG. 6 is a sectioned view of a substrate, with a slurry layer having a first region and a second region, and at least one covering layer applied thereto, according to an embodiment of the present disclosure.
Figure 7:
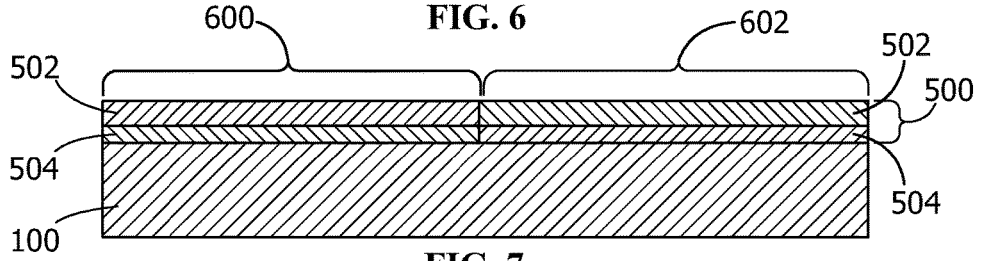
FIG. 7 is a sectioned view of the substrate of FIG. 6 after formation of a diffusion coating on the substrate, according to an embodiment of the present disclosure.

Referring to FIG. 6, in one embodiment, the slurry layer 102 includes a first region 600 and a second region 602. The first region 600 may be adjacent to or remote from the second region 602. The first region 600 and the second region 602 may be formed from slurries 102 having the same composition or different compositions. In one embodiment, the first region 600 is an aluminizing slurry layer form of the slurry layer 200 (formed from an aluminizing slurry) and the second region 602 is a chromizing slurry layer form of the slurry layer 200 (formed from a chromizing slurry). Referring to FIG. 7, in a further embodiment, the first region 600 remains distinct from the second region 602 during and after the formation of the diffusion coating 500 such that the diffusion coating 500, additive layer 502, and interdiffusion zone 504 retain the first region 600 and the second region 602. The slurry layer 102 and the diffusion coating 500 may include a third or any number of additional regions. In one embodiment, the first region 600 includes cracks (not shown) suitable for treatment with an aluminizing slurry, and the first region is 600 is an aluminizing slurry layer form of the slurry layer 200. In another embodiment, the second region 600 includes cracks (not shown) suitable for treatment with a chromizing slurry, and the second region is 602 is a chromizing slurry layer form of the slurry layer 200. In yet another embodiment, the first region 600 includes cracks (not shown) suitable for treatment with an aluminizing slurry, and the first region is 600 is an aluminizing slurry layer form of the slurry layer 200, and the second region 600 includes cracks (not shown) suitable for treatment with a chromizing slurry, and the second region is 602 is a chromizing slurry layer form of the slurry layer 200. Tailoring diffusion treatment of cracks based on the exposed internal composition of the cracks in different regions of the substrate 100 may improve diffusion treatment of the cracks, particularly, for example, if the exposed internal compositions of the cracks are different than other portions of the substrate 100 to which diffusion treatments are being applied.

Figure 8:
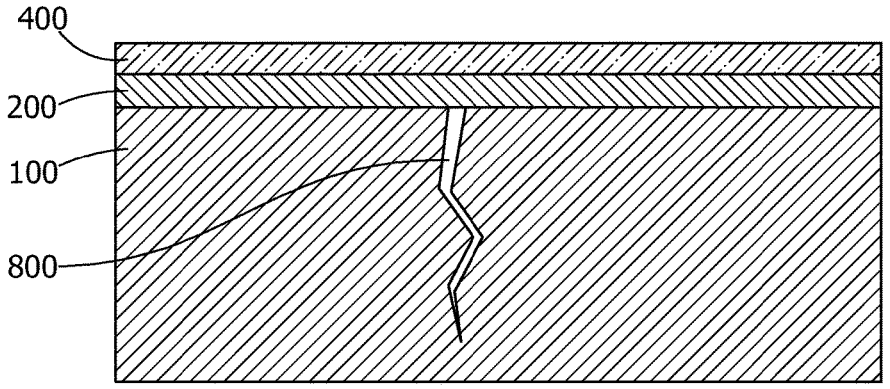
FIG. 8 is a sectioned view of a substrate having a crack, with a slurry layer and at least one covering layer applied thereto, according to an embodiment of the present disclosure.
Figure 9:
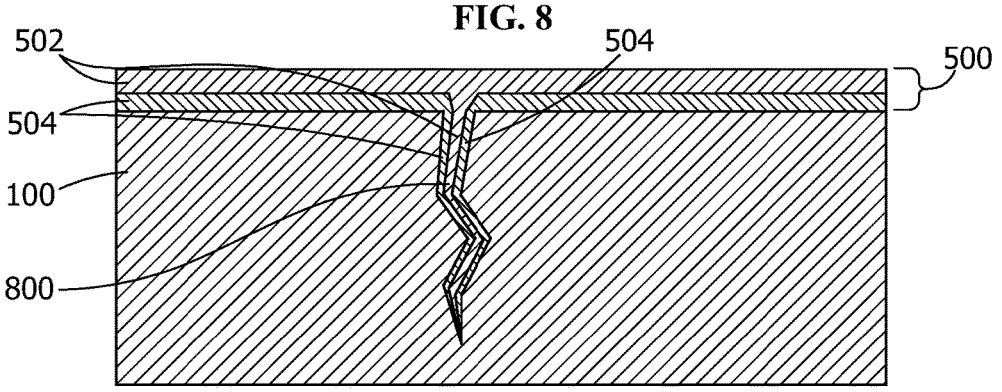
FIG. 9 is a sectioned view of the substrate of FIG. 8 after formation of a diffusion coating on the substrate, according to an embodiment of the present disclosure.

Referring to FIGS. 8 and 9, in one embodiment, the substrate 100 includes a crack 800, and applying the at least one covering layer 400 over the slurry layer 200 adjacent to the crack 800 increases formation of the diffusion coating 500 within the crack relative to a comparable process lacking the at least one covering layer 400. The at least one covering layer 400 may reduce propagation of the crack 800 relative to the comparable process lacking the at least one covering layer 400. The crack 800 may penetrate through less than a thickness of the substrate 100 or may penetrate through the entire thickness of the substrate 100. In a further embodiment, the slurry layer 200 covers the opening of the crack 800, and during the heating of the slurry layer 200 and the at least one covering layer 400, at least a portion of the binder in the slurry layer 200 burns off, and at least a portion of the activator in the slurry layer vaporizes and reacts with the metallic donor of the donor metal powder to form a halide vapor which reacts at the crack surface within the crack 800 to deposit metal (e.g., aluminum or chromium) on the crack surfaces, and diffuse the deposited metal into the crack surfaces to form a diffusion metal coating. Without being bound by theory, it is believed that the presence of the at least one covering layer 400 enhances the penetration of the halide vapor into the crack 800, and promotes the formation of the metal diffusion coatings on both sides of the crack 800, growing the metal diffusion coating from both sides of the crack 800 to heal the crack 800 when the metal diffusion coatings from both sides join together. In one embodiment, it is the additive layer 502 which grows outward during the heating of the slurry layer 200 and the at least one covering layer 400 to heal the crack 800.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A process for forming an aluminide diffusion coating on a substrate, the process comprising:

preparing an aluminizing slurry including a donor metal powder, an activator powder, and a binder;

applying the aluminizing slurry to the substrate;

drying the aluminizing slurry on the substrate, forming at least a portion of a slurry layer on the substrate;

applying a covering composition over the slurry layer;

drying the covering composition, forming at least one covering layer enclosing the slurry layer against the substrate, wherein the covering layer consists of at least one polymer adhesive, at least one ceramic powder, at least one viscosity thinning agent, or combinations thereof;

heating the slurry layer and the at least one covering layer to form the aluminide diffusion coating on the substrate, the aluminide diffusion coating including an aluminide additive layer and an aluminide interdiffusion zone disposed between the substrate and the aluminide additive layer; and removing the at least one covering layer.

2. The process of claim 1, wherein the covering layer consists of at least one polymer adhesive and at least one ceramic powder.

3. The process of claim 1, wherein the covering layer consists of at least one polymer adhesive, at least one ceramic powder, and at least one viscosity thinning agent.

4. The process of claim 1, wherein applying the covering composition includes a technique selected from the group consisting of painting, brushing, dipping, and combinations thereof.

5. The process of claim 1, wherein the donor metal powder includes a metallic aluminum alloy having a melting temperature higher than aluminum, and the binder includes at least one organic polymer gel.

6. The process of claim 5, wherein the donor metal powder includes a chromium-aluminum alloy.

7. The process of claim 5, wherein the aluminizing slurry includes, by weight, about 35% to about 65% of the donor metal powder, about 1% to about 50% of the activator powder, and about 25% to about 60% of the binder.

8. The process of claim 7, wherein the aluminizing slurry further includes, by weight, about 1% to about 30% ceramic powder and about 1% to about 10% oxide removal agent.

9. The process of claim 1, wherein the slurry layer includes a first region and a second region, the first region being an aluminizing slurry layer formed from the aluminizing slurry, and the second region being a chromizing slurry layer formed from a chromizing slurry, wherein both the first region and the second region are enclosed by the at least one covering layer against the substrate.

10. The process of claim 1, wherein the activator powder is selected from the group consisting of ammonium chloride, ammonium fluoride, ammonium bromide, and combinations thereof.

11. The process of claim 1, wherein heating the slurry layer and the at least one covering layer to form the aluminide diffusion coating includes heating the slurry layer and the at least one covering layer to a temperature within a range of about 550° C. to about 1250° C.

12. The process of claim 1, wherein forming the aluminide diffusion coating includes forming the aluminide diffusion coating as an additive coating which adds a metal onto the substrate.

13. The process of claim 1, further including a pre-coating cleaning prior to applying the aluminizing slurry.

14. The process of claim 1, wherein applying the aluminizing slurry to the substrate includes applying the aluminizing slurry to a turbine component selected from the group consisting of a bucket, a nozzle, a shroud, a diaphragm, a combustor, a hot gas path component, and combinations thereof.

15. The process of claim 1, wherein heating the slurry layer and the at least one covering layer to form the aluminide diffusion coating includes a duration of from about 2 hours to about 8 hours.

16. The process of claim 1, wherein applying the aluminizing slurry includes a technique selected from the group consisting of spraying, painting, brushing, and combinations thereof.

17. The process of claim 1, wherein the substrate includes a crack, and applying the at least one covering layer over the slurry layer adjacent to the crack increases formation of the aluminide diffusion coating within the crack relative to a comparable process lacking the at least one covering layer, reducing propagation of the crack relative to the comparable process.

18. The process of claim 17, wherein the crack penetrates through less than a thickness of the substrate.

19. The process of claim 1, wherein the at least one viscosity thinning agent is selected from the group consisting of $NH_4Cl$, $NH_4F$, $NH_4Br$, and combinations thereof.

20. The process of claim 1, wherein the substrate includes a bond coat, and the aluminizing slurry is applied directly to the bond coat.

* * * * *